US006457821B1

(12) United States Patent
Liu et al.

(10) Patent No.: US 6,457,821 B1
(45) **Date of Patent: *Oct. 1, 2002**

(54) FILTER CARRIER FOR PROTECTING A FILTER FROM BEING BLOCKED BY AIR BUBBLES IN AN INKJET PRINTHEAD

(75) Inventors: Kan Liu, San Diego, CA (US); Steven W. Steinfield, San Diego, CA (US); Joseph E. Scheffelin, Poway, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/805,073

(22) Filed: Mar. 13, 2001

(51) Int. Cl.[7] ..... B41J 2/175
(52) U.S. Cl. ..... 347/93; 347/87
(58) Field of Search ..... 347/85, 86, 87, 347/92, 93, 71

(56) References Cited

U.S. PATENT DOCUMENTS 5,489,930 A * 2/1996 Anderson ..... 347/71
5,886,721 A * 3/1999 Fujii et al. ..... 347/87
6,234,622 B1 * 5/2001 Liu et al. ..... 347/93
6,270,212 B1 * 8/2001 Kusumi et al. ..... 347/93

* cited by examiner

*Primary Examiner*—Anh T. N. Vo

(57) ABSTRACT

The present invention overcomes the problem of filter blockage created by bubble accumulation underneath the filter of previous printheads with a filter carrier and filter that reduces air bubble blockage of the filter. Namely, air bubble blockage of the filter is avoided by trapping more bubbles in a designated area with a horizontal ink flow, relative to the substrate. In addition to the filter carrier and filter, the printing device further includes an outer housing, a substrate and an ink conduit. The substrate has a back surface and a front surface with ink ejection chambers formed thereon. The ink conduit has a distal end proximate to the back surface of the substrate. The ink conduit, the outer housing and the substrate define an ink flow path to the ink ejection chambers and a bubble accumulation chamber in communication with the ink flow path such that buoyancy will tend to move bubbles that accumulate in the ink flow path into the bubble accumulation chamber.

20 Claims, 11 Drawing Sheets

FILTER CARRIER FOR PROTECTING A FILTER FROM BEING BLOCKED BY AIR BUBBLES IN AN INKJET PRINTHEAD

CROSS-REFERENCE TO RELATED APPLICATIONS

This application is related to U.S. patent application Ser. No. 08/742,253, filed Oct. 31, 1996, entitled "PRINT CARTRIDGE COUPLING AND RESERVOIR ASSEMBLY FOR USE IN AN INKJET PRINTING SYSTEM WITH AN OFF-AXIS INK SUPPLY". The foregoing commonly assigned patent applications are herein incorporated by reference.

FIELD OF THE INVENTION

This invention relates to inkjet printers and, more particularly, to an inkjet printer having a scanning printhead with an ink delivery system that utilizes a filter carrier to protect a filter from being blocked by air bubbles in an inkjet printhead.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of Output Hardcopy Devices (Ed. R. C. Durbeck and S. Sherr, San Diego: Academic Press, 1988) and U.S. Pat. Nos. 4,490,728 and 4,313,684. The basics of this technology are further disclosed in various articles in several editions of the Hewlett-Packard Journal [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers, which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

A concern with inkjet printing is the sufficiency of ink flow to the paper or other print media. Print quality is a function of ink flow through the printhead. Too little ink on the paper or other media to be printed upon produces faded and hard-to-read documents.

Inkjet printheads are typically attached to a housing or body of a print cartridge. The inkjet printhead ink is fed from an internal ink reservoir integral to the print cartridge or from an "off-axis" ink supply which feeds ink to the print cartridge via tubes connecting the print cartridge and ink supply. A print cartridge having an "off-axis" ink supply usually also has a very small internal ink reservoir. In either case, the housing has an ink conduit for supplying ink from an internal ink reservoir to the printhead.

Ink is then fed to the various vaporization chambers either through an elongated hole formed in the center of the bottom of the substrate, "center feed", or around the outer edges of the substrate, "edge feed". In center feed the ink then flows through a central slot in the substrate into a central manifold area formed in a barrier layer between the substrate and a nozzle member, then into a plurality of ink inlet channels, and finally into the various ink vaporization chambers. In edge feed ink from the ink reservoir flows around the outer edges of the substrate into the ink inlet channels and finally into the ink vaporization chambers. Inkjet printheads are very sensitive to particulate contamination. To deal with this problem, a filter is typically disposed in the ink fluid path between the reservoir of ink and the printhead.

In either center feed or edge feed, the flow path from the ink reservoir to the printhead inherently provides restrictions on ink flow to the ink vaporization chambers. A concern with inkjet printing is the sufficiency of ink flow to the paper or other print media. Print quality is a function of ink flow through the printhead. Too little ink on the paper or other media to be printed upon produces faded and hard-to-read documents.

Inkjet printheads are typically attached to a housing or body of a print cartridge, which contains an ink reservoir. The housing has a conduit for supplying ink from the ink reservoir to the printhead. Inkjet printheads are very sensitive to particulate contamination. To deal with this problem, a filter is typically disposed between the reservoir of ink and the printhead. A filter is attached to the inside of the housing, separating the ink delivery portion of the housing into two regions—one upstream and one downstream of the filter. This type of design has a number of drawbacks.

First, the housing material tends to be selected for structural rigidity and high heat deflection. Fillers (such as glass fibers) are typically included to enhance these properties. Such materials tend to be difficult surfaces to which to attach a filter and effect a complete seal around the perimeter of the filter. If the seal is not complete, bubbles or particulates may slip past the filter and block the ink channels or nozzles.

One method to improve upon this is to provide a second plastic material by insert molding to rigid outer housing. However insert molding is very expensive and the outer rigid housing must be adapted to be compatible with insert molding. The separation the filter staking from the cartridge housing would provide more freedom of material selection for both the cartridge housing and a good heat staking material for the filter carrier. Moreover, the filter staking process is greatly simplified when it can be performed external to the cartridge housing is done outside a pen body. All of these difficulties are even further compounded by the advent of a new design that provides a jet impinging flow of ink to cool the printhead. This design makes the molding of the rigid housing very difficult.

Another problem that occurs during the life of the print element is air out gassing. Air builds up between the filter and the printhead during operation of the printhead. Ink delivery systems are capable of releasing gasses and generating bubbles, thereby causing systems to get clogged and degraded by bubbles. In the design of a good ink delivery system, it is important that techniques for eliminating or reducing bubble problems be considered. Therefore, another problem that occurs during the life of the print element is air out-gassing. Air builds up between the filter and the printhead during operation of the printhead. For printers that have a high use model, it would be preferable to have a larger volume between the filter and the printhead for the storage of air. For low use rate printers, this volume would be reduced.

There is a need for high speed printing devices, such as desktop printers, large format printers, facsimile machines and copiers. In the past, printheads have not had the ability to operate at high speed ink ejection rates required for high speed printing rates due to lack of the ability to remove the large amount of heat generated.

Accordingly, there is a need for a new filter carrier for protecting a filter from being blocked by air bubbles in an inkjet printhead operating at high speed printing rates.

SUMMARY OF THE INVENTION

The present invention is a printing device including a filter carrier with a filter. The present invention overcomes the problem of filter blockage created by bubble accumulation underneath the filter of previous printheads with a filter carrier and filter that reduces air bubble blockage of the filter. Namely, air bubble blockage of the filter is avoided by trapping more bubbles in a designated area. In addition to the filter carrier and filter, the printing device further includes an outer housing, a substrate and an ink conduit. The substrate has a back surface and a front surface with ink ejection chambers formed thereon. The ink conduit has a distal end proximate to the back surface of the substrate. The ink conduit, the outer housing and the substrate define an ink flow path to the ink ejection chambers and a bubble accumulation chamber in communication with the ink flow path such that buoyancy will tend to move bubbles that accumulate in the ink flow path into the bubble accumulation chamber.

The filter carrier is located within the print cartridge towards the back of the substrate. An ink conduit is defined by the walls of filter carrier, narrow ink slots on a bottom surface of the filter carrier and the walls of the cartridge body. The ink slots define conduit openings that are adjacent to the bottom surface of the filter carrier. The conduit openings on each side of the filter carrier can define the narrow ink slots. The bottom surface of the filter carrier is preferably flat and provides ink flow through the slots over the bottom surface in a horizontal direction, relative to the substrate. The bottom surface of the filter carrier is substantially aligned in a direction parallel to the back surface of substrate. The slots include openings that face the inner walls and are above the back surface of substrate.

The ink slots direct the flow of ink along the side of substrate through a gap between the back of the substrate and the bottom surface of the filter carrier. As the fluid flows from the ink conduit and through the slots, it impinges on the substrate, thereby causing heat transfer from the substrate into the ink. This happens as the ink flows toward the drop ejection chambers where the warm ink is ejected onto media. Since the bottom surface of the filter carrier is substantially aligned in a direction parallel to the back surface of substrate, the ink flows horizontally out of the slots, relative the substrate. This in turn helps trap more bubbles in bubble accumulation chambers. In addition, the warming of the ink in the bubble accumulation chambers may be reduced and heat transfer between substrate and the ink can be improved.

The filter divides the ink delivery portion of the housing into upstream and downstream sections such that ink flows from the upstream portion through the filter to the downstream portion and to the printhead. The separation the filter staking from the cartridge housing provides more freedom of material selection for both the cartridge housing and a good heat staking material for the filter carrier. The separation also greatly simplifies the molding of the rigid cartridge housing. Also, the filter staking process is greatly simplified when it is performed external to the cartridge housing. The present invention also provides the ability to have an adjustable air warehouse volume to accommodate various outgassing rates of different print usages cartridge usages.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

Figure 1:
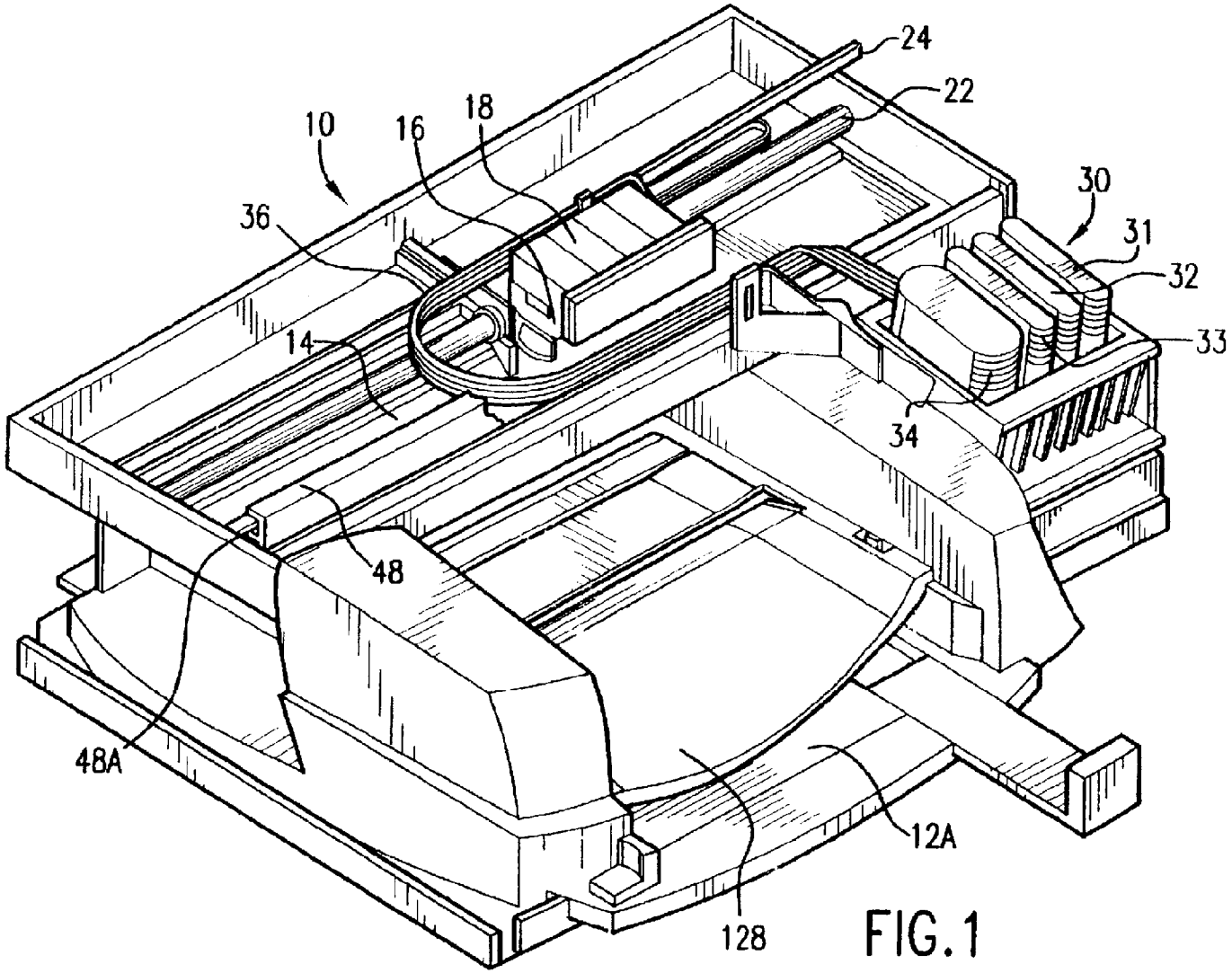
FIG. 1 is a perspective view of one embodiment of an inkjet printer incorporating the present invention.

While the present invention will be described below in the context of an off-axis printer having an external ink source, it should be apparent that the present invention is equally useful in an inkjet printer which uses on-axis inkjet print cartridges having an ink reservoir integral with the print cartridge. FIG. 1 is a perspective view of one embodiment of an inkjet printer 10, with its cover removed, suitable for utilizing the present invention. Generally, printer 10 includes a tray 12A for holding virgin paper. When a printing operation is initiated, a sheet of paper from tray 12A is fed into printer 10 using a sheet feeder, then brought around in a U direction to now travel in the opposite direction toward tray 12B. The sheet is stopped in a print zone 14, and a scanning carriage 16, supporting one or more print cartridges 18, is then scanned across the sheet for printing a swath of ink thereon. After a single scan or multiple scans, the sheet is then incrementally shifted using a conventional stepper motor and feed rollers to a next position within the print zone 14, and carriage 16 again scans across the sheet for printing a next swath of ink. When the printing on the sheet is complete, the sheet is forwarded to a position above tray 12B, held in that position to ensure the ink is dry, and then released.

The carriage 16 scanning mechanism may generally include a slide rod 22, along which carriage 16 slides and a flexible electrical cable (not shown), which transmits electrical signals from the printer's microprocessor to electrical contacts on the carriage 16. Also shown is a coded strip 24, which is optically detected by a photo detector on carriage 16 for precisely spatially positioning carriage 16. A motor (not shown), connected to carriage 16 is used for transporting carriage 16 along slide rod 22 across print zone 14.

The features of inkjet printer 10 also include an ink delivery system for providing ink to the print cartridges 18 and ultimately to the ink ejection chambers in the printheads from an off-axis ink supply station 30 containing replaceable ink supply cartridges 31, 32, 33, and 34, which may be pressurized or at atmospheric pressure. For color printers, there will typically be a separate ink supply cartridge for black ink, yellow ink, magenta ink, and cyan ink. Four tubes 36 carry ink from the four replaceable ink supply cartridges 31-34 to the print cartridges 18.

Figure 2:
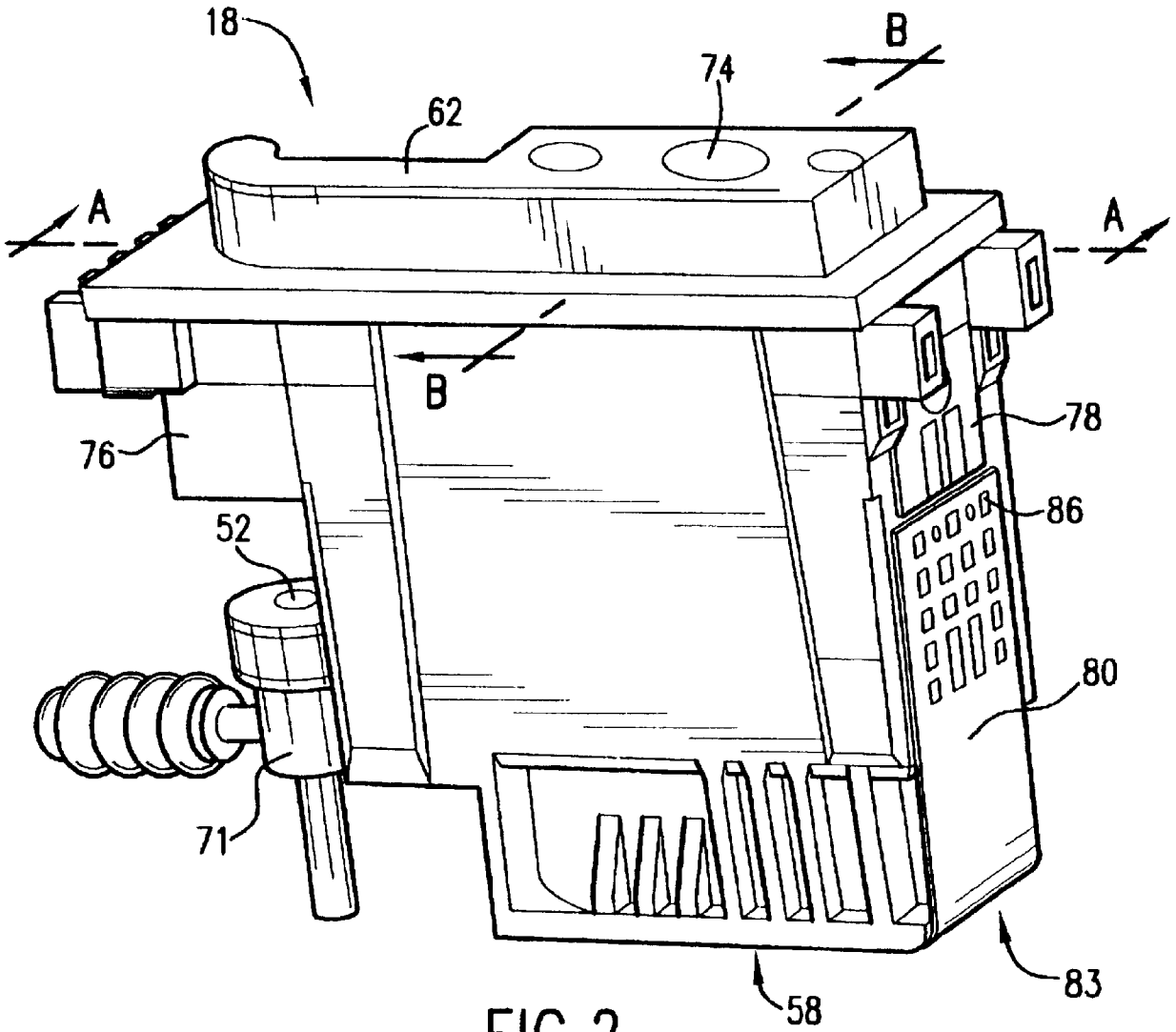
FIG. 2 is a perspective view of a single print cartridge showing the flexible electric circuit and its electrical contact pads and also showing the fluid interconnect to the carriage.

FIG. 2 is a perspective view of one embodiment of a print cartridge 18. The printhead nozzle array is at location 58. An integrated circuit chip 78 provides feedback to the printer regarding certain parameters of print cartridge 18. A flexible electrical tape circuit 80 contains electrical contact pads 86, electrical leads 84 (shown in FIG. 5) and nozzles 82 (shown in FIG. 3) laser ablated through tape 80. The flexible electrical tape circuit 80 is affixed to the printhead substrate 88 and to the barrier layer 104 to form a printhead assembly 83. Printhead assembly 83 is then secured to print cartridge 18 as described below with respect to FIG. 7. The contact pads 86 align with and engage electrical contacts (not shown) on carriage 16 when the print cartridge 18 is installed in carriage 16. Preferably, the electrical contacts on carriage 16 are resiliently biased toward print cartridge 18 to ensure a reliable contact.

A septum elbow 71 routes ink from the carriage 16 to the septum 52 and supports the septum. An air vent 74 formed in the top of print cartridge 18 is used by a pressure regulator located in print cartridge 18 and described below. In an alternative embodiment, a separate regulator may be connected between the off-axis ink supply and each print cartridge 18. When the print cartridges 18 are installed in carriage 16, the print cartridges 18 are in fluid communication with an off-carriage ink supply 31–34 that is releasably mounted in ink supply station 30.

Figure 3:
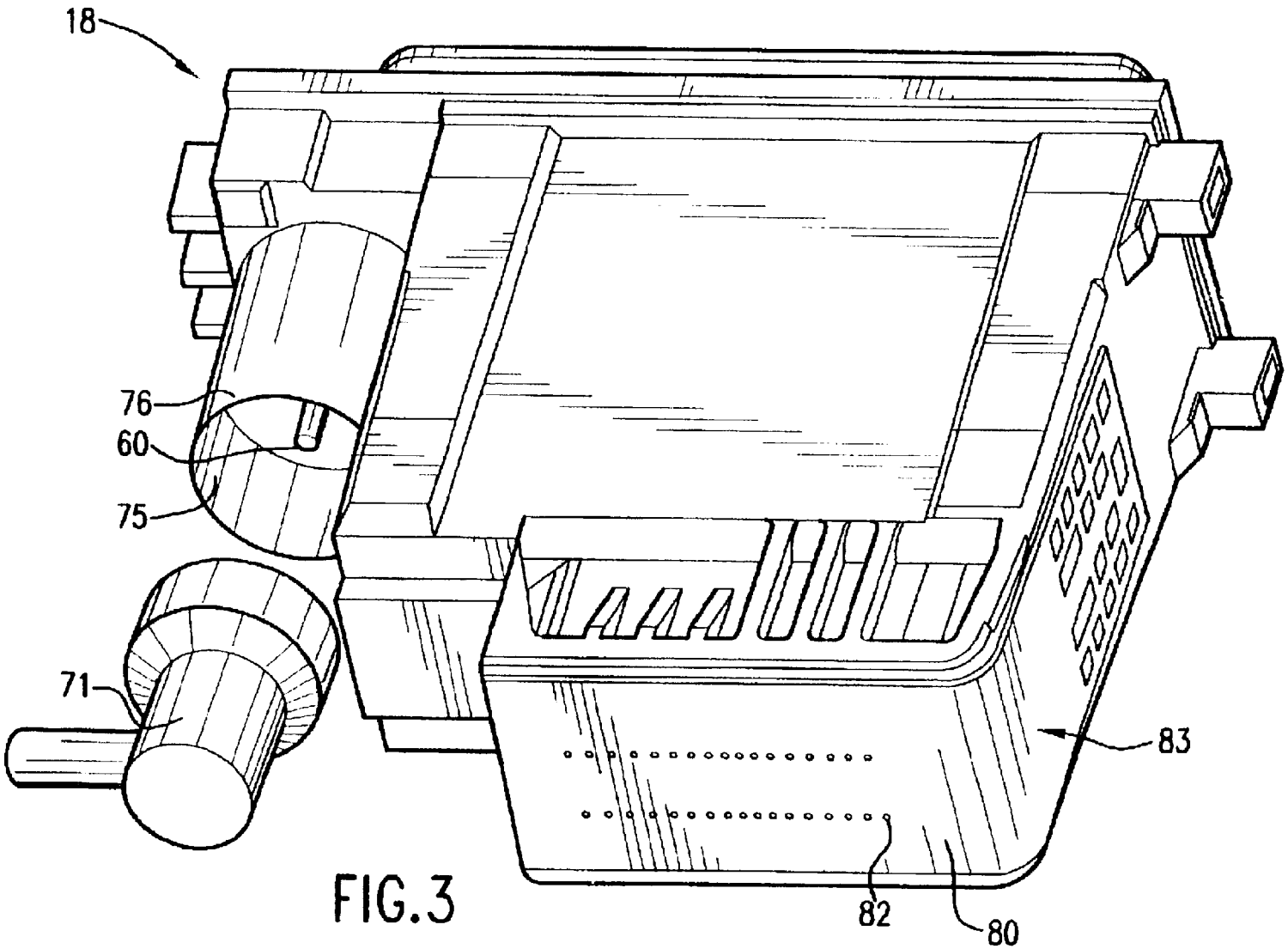
FIG. 3 is another perspective view of a single print cartridge showing the printhead portion on the bottom surface of the cartridge and the fluid interconnect to the carriage.

FIG. 3 illustrates the bottom side of print cartridge 18. Two parallel rows of offset nozzles 82 are laser ablated through tape 80.

Figure 4:
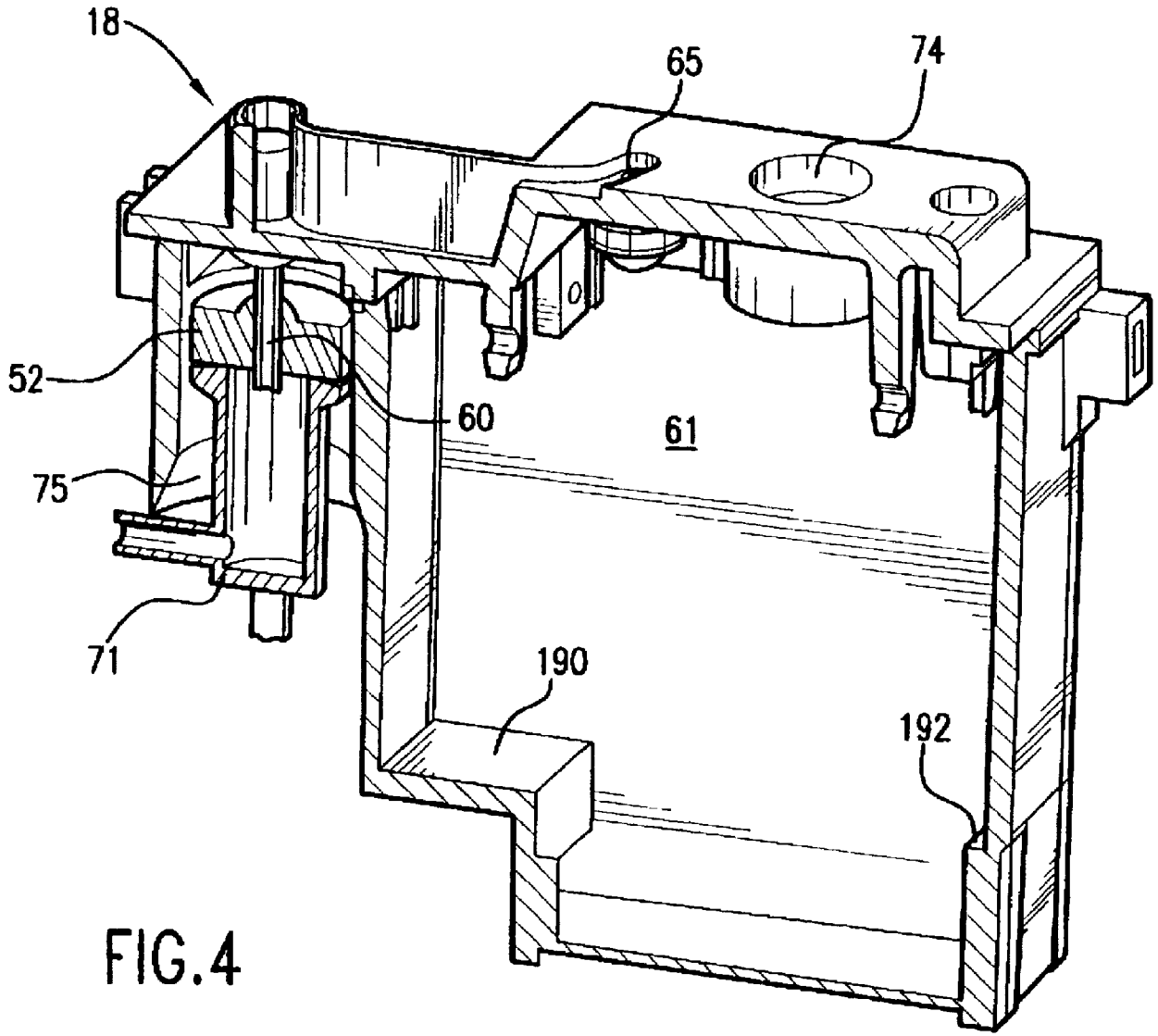
FIG. 4 is a cross-sectional, perspective view along line A—A of the print cartridge of FIG. 2 showing the print cartridge connected to the fluid interconnect on the carriage.

FIG. 4 is a cross-sectional perspective view of print cartridge 18, with tape 80 removed, taken along line A—A in FIG. 2. A shroud 76 surrounds the hollow needle 60 to prevent inadvertent contact with needle 60 and also to help align septum 52 with needle 60 when installing print cartridge 18 in carriage 16. Shroud 76 is shown having an inner conical or tapered portion 75 to receive septum 52 and center septum 52 with respect to needle 60. A plastic conduit 62 leads from the needle 60 to chamber 61 via hole 65.

Embodiments of scanning carriages and print cartridges are described in U.S. patent application Ser. No. 08/706,121, now U.S. Pat. No. 5,996,155 filed Aug. 30, 1996, entitled "Inkjet Printing System with Off-Axis ink Supply Having ink Path Which Does Not Extend above Print Cartridge," which is herein incorporated by reference.

A regulator valve (not shown) within print cartridge 18 regulates pressure by opening and closing an inlet hole 65 to an internal ink chamber 61 of print cartridge 18. When the regulator valve is opened, the hollow needle 60 is in fluid communication with an ink chamber 61 internal to the cartridge 18. The needle 60 extends through a self-sealing hole formed in through the center of the septum 52. The hole is automatically sealed by the resiliency of the rubber septum 52 when the needle is removed.

For a description of the design and operation of the regulator see U.S. patent application Ser. No. 08/706,121, now U.S. Pat. No. 5,966,155 filed Aug. 30, 1996, entitled "Inkjet Printing System with Off-Axis Ink Supply Having Ink Path Which Does Not Extend above Print Cartridge," which is herein incorporated by reference.

Figure 5:
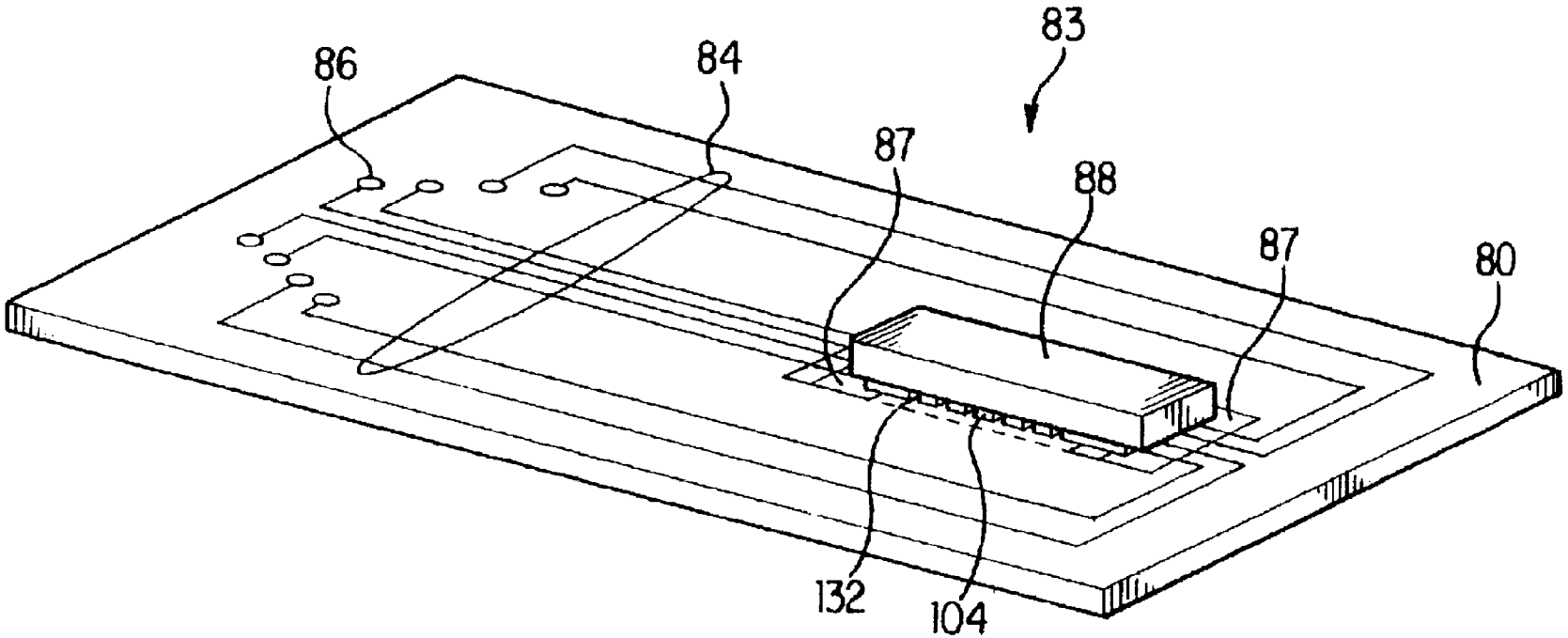
FIG. 5 is a simplified perspective view of the back side of the printhead assembly.

FIG. 5 shows a simplified schematic of the printhead assembly 83 shown in FIGS. 2 and 3. Electrical leads 84 are formed on the back of tape 80 and terminate in contact pads 86 for engaging electrical contacts on carriage 16. The other ends of electrical leads 84 are bonded through windows 87 to terminals of a substrate 88 on which are formed the various ink ejection chambers and ink ejection elements. The ink ejection elements may be heater resistors or piezoelectric elements.

A demultiplexer on substrate 88 demultiplexes the incoming electrical signals applied to contact pads 86 and selectively energizes the various ink ejection elements to eject droplets of ink from nozzles 82 as printhead 83 scans across the print zone. In one embodiment, the dots per inch (dpi) resolution is 600 dpi, and there are 512 nozzles 82.

Figure 6:
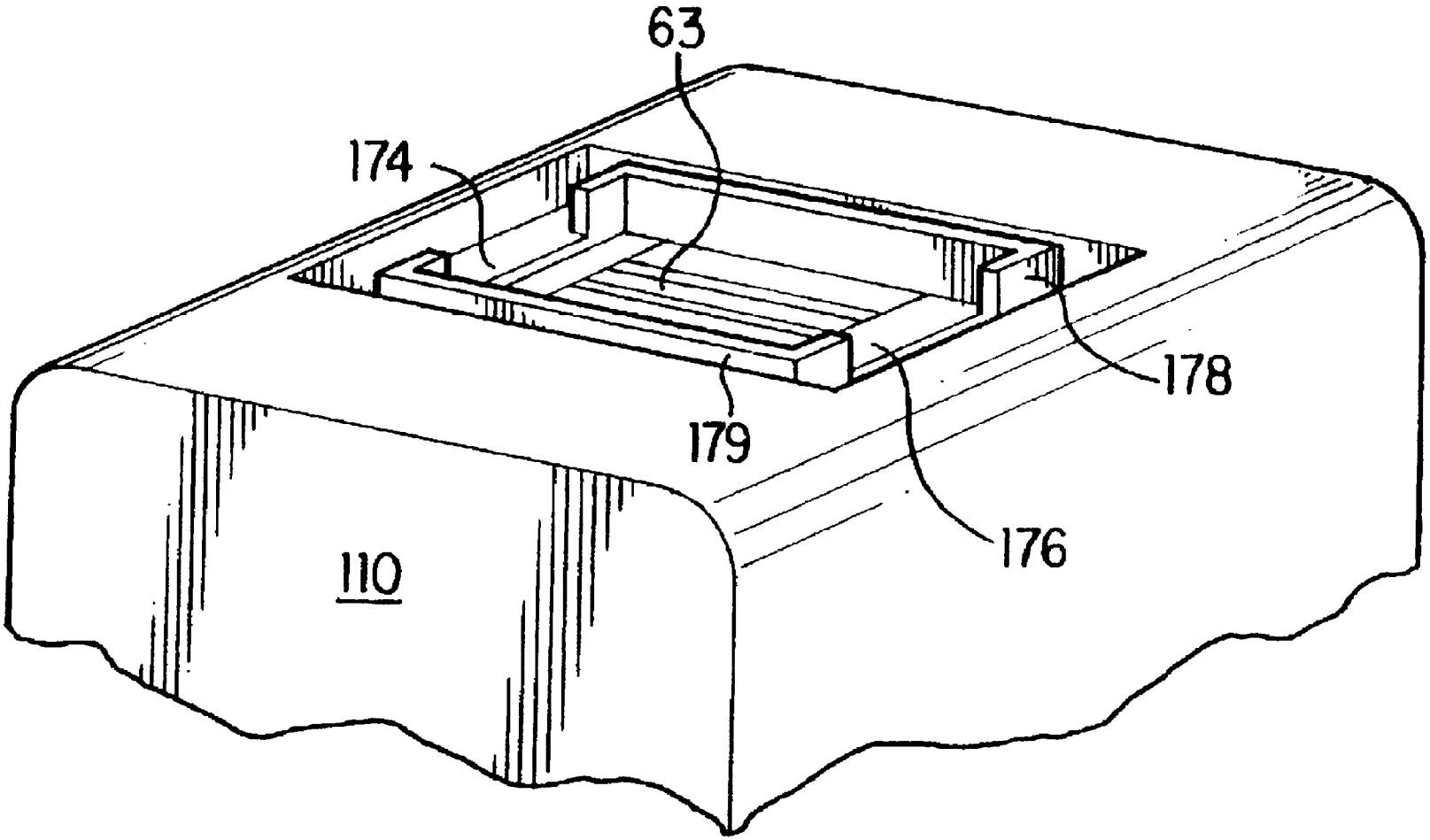
FIG. 6 is a perspective view the of print cartridge of FIG. 2 showing the headland area where the substrate and flex tape is attached.

FIG. 6 is perspective view of the print cartridge 18 with the printhead assembly 83 removed. An adhesive/sealant is applied to headland areas 174 and 176 and along the top of headland walls 178 and 179 to secure the printhead assembly 83 to the print cartridge body 110. The adhesive/sealant at areas 174 and 176 squishes upward to secure the ends of the substrate 88 to the print cartridge body 110 and insulates the electrical leads 84 on the back of tape 80 so they will not be shorted by ink in the vicinity of the electrical leads 84.

Figure 7:
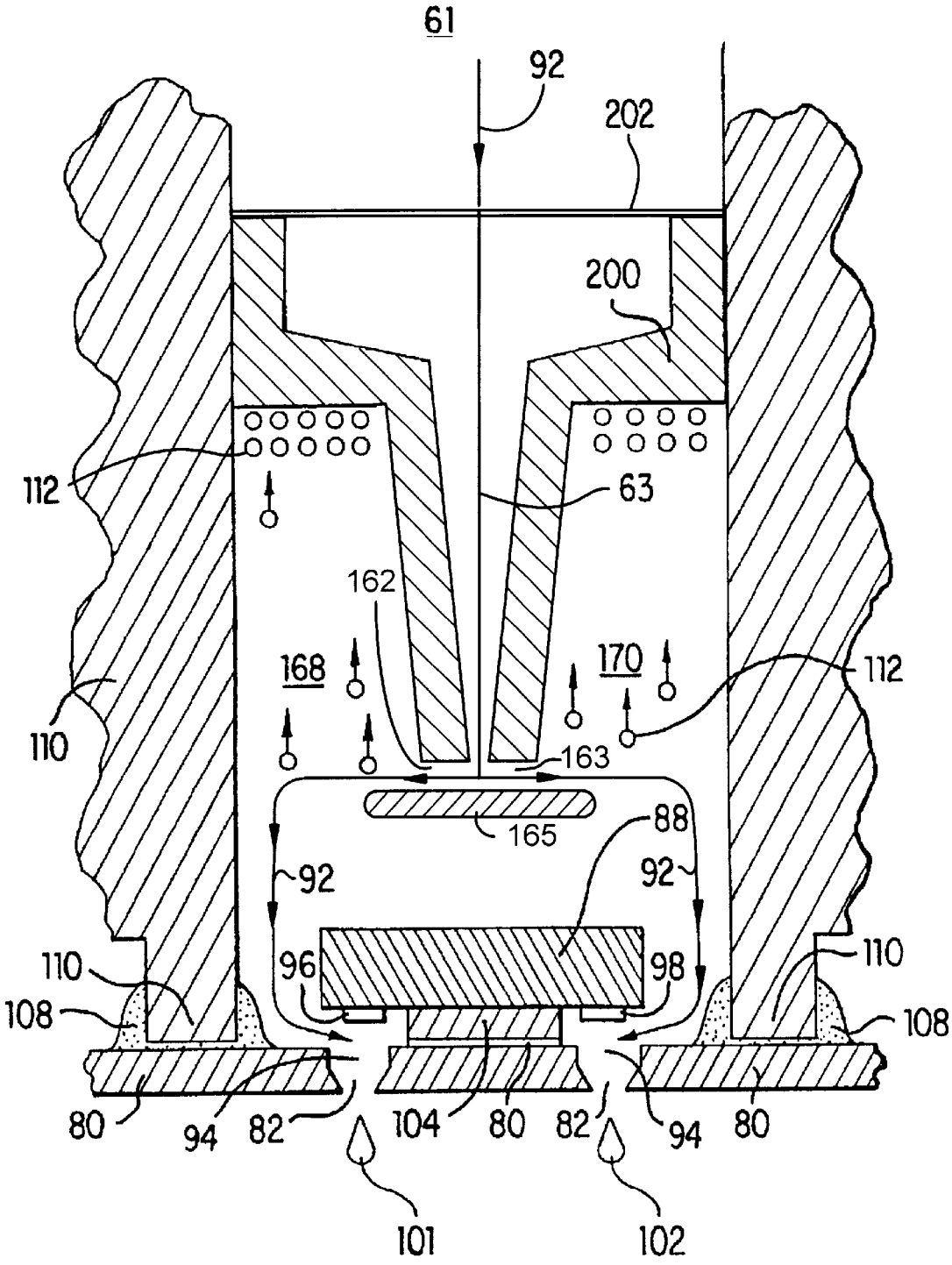
FIG. 7 is a cross-sectional view along line B—B of FIG. 2 showing the flow of ink to the ink ejection chambers in an edge feed printhead using an embodiment of the present invention.

FIG. 7 is a cross-sectional view along line B—B of FIG. 2 showing the flow of ink 92 from the ink chamber 61 within print cartridge 18 to ink ejection chambers 94 in an edge feed printhead using one embodiment of the present invention. Elements identified with the same numerals as in other figures may be identical and will not be redundantly described.

The barrier layer 104, the flexible tape 80 and substrate 88 define the ink inlet channels 132 and ink vaporization chambers 94. Energization of the ink ejection elements 96 and 98 cause a droplet of ink 101, 102 to be ejected through the nozzles 82 associated with the ink ejection chambers 94. The conductor portion of the flexible tape 80 is glued with adhesive 108 to the plastic print cartridge body 110. For a description of the barrier layer defining the ink inlet channels 132, the ink vaporization chambers 94, the heater resistors 96, 98 within the ink vaporization chambers 94 and the electrical circuitry of the printhead, see U.S. patent application Ser. No. 08/962,031, filed Oct. 31, 1997, entitled "Ink Delivery System for High Speed Printing;"

Figure 8:
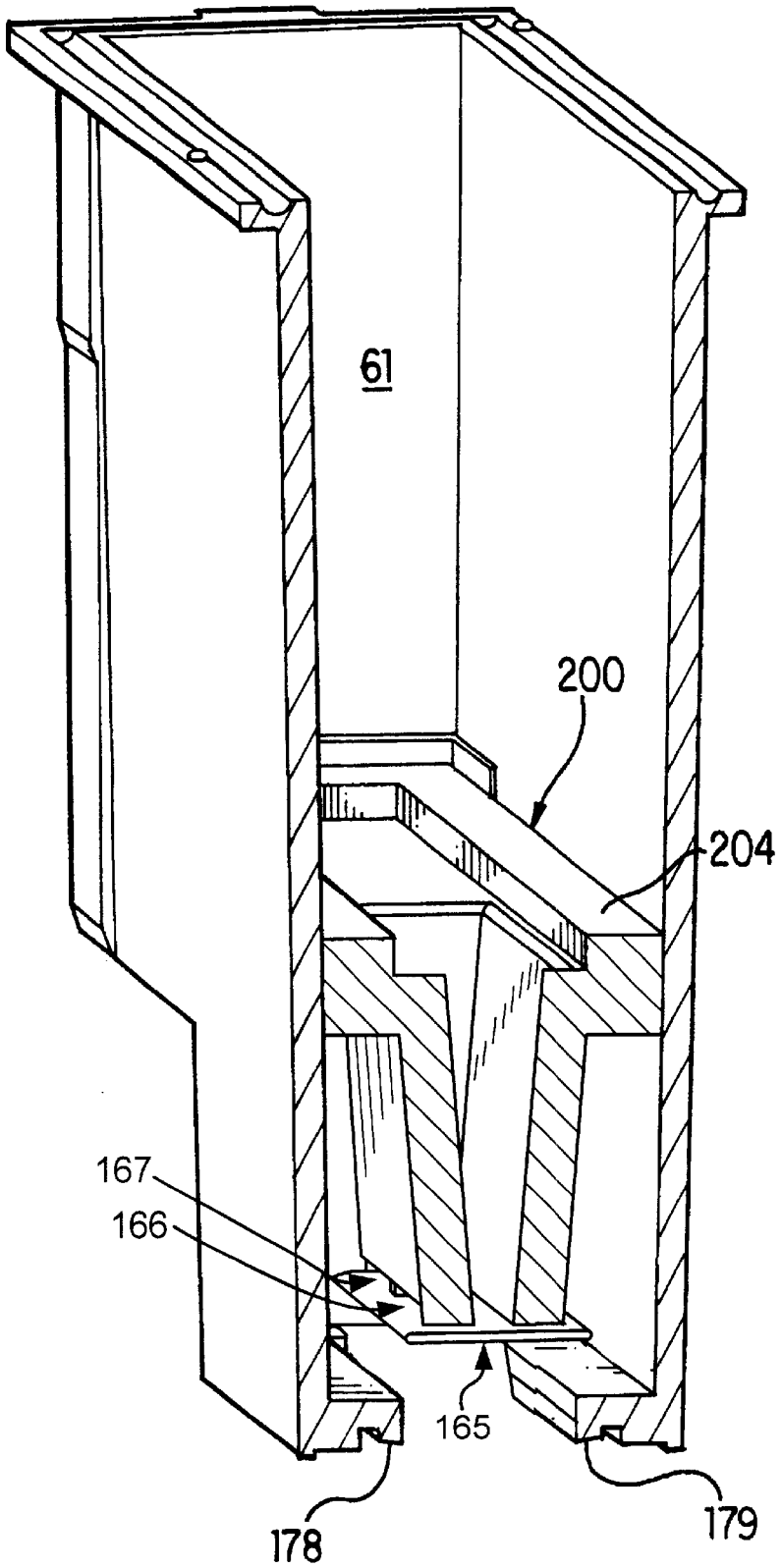
FIG. 8 is a cross-sectional view along line B—B of FIG. 2 showing the flow of ink to the ink ejection chambers in an edge feed printhead using an embodiment of the present invention.

The plastic body 110 of print cartridge 18 is formed such that the ink conduit 63 directs the flow of ink as arrow 92 from ink chamber 61 within the print cartridge 18 towards the back of the substrate 88. Ink conduit 63 is defined by the walls of filter carrier 200, narrow ink slots 162, 163 on a bottom surface 165, and the walls of cartridge body 110. The ink slots 162, 163 define conduit openings 166, 167 (as shown in FIG. 8) that are adjacent to the bottom surface 165. The conduit openings 166, 167 on each side of the filter carrier 200 can define the narrow ink slots 162 and 163, as shown in FIG. 8. The bottom surface 165 is preferably flat and provides ink flow through the slots 162, 163 over the bottom surface in a horizontal direction, relative to the substrate 88, as shown by arrow 92. The bottom surface 165 is substantially aligned in a direction parallel to the back surface of substrate 88. Slots 162, 163 include openings 166, 167 that face the inner walls and are above the back surface of substrate 88.

Ink slots 162, 163 direct the flow of ink as shown by arrow 92 along the side of substrate 88 through a gap between the back of the substrate 88 and the bottom surface 165 of the filter carrier 200. As the fluid flows from the ink conduit 63 and through the slots 162, 163, it impinges on the substrate 88, thereby causing heat transfer from the substrate 88 into the ink. This happens as the ink flows toward the drop ejection chambers where the warm ink is ejected onto media. Since the bottom surface 165 is substantially aligned in a direction parallel to the back surface of substrate 88, the ink flows horizontally out of the slots 162, 163, relative the substrate 88. This in turn helps trap more bubbles 112 in bubble accumulation chambers 168, 170.

Inkjet printheads are very sensitive to particulate contamination. To deal with this problem, a filter 202 is preferably used between the reservoir of ink 61 and the printhead 83. The filter 202 prevents particulate contaminates from flowing from the ink reservoir 61 to the printhead 83 and clogging the printhead nozzles 82.

Another problem that occurs during the life of the print element is air out-gassing. Air builds up between the filter 202 and the printhead 83 during operation of the printhead. Shown in FIG. 7 are bubble accumulation chambers 168, 170 defined and formed by the walls of filter carrier 200 and the walls of cartridge body 110. As the ink heats up, the solubility of air in the ink decreases, and air defuses out of the ink in the form of bubbles 112. In order for these bubbles 112 to not restrict the flow of ink, bubble accumulation chambers 168, 170 are formed in the print cartridge body to accumulate these bubbles. Since the ink flows horizontally out of the slots 162, 163, relative the substrate 88 more bubbles 112 are trapped in bubble accumulation chambers 168, 170.

The bubble accumulation chambers 168, 170 are positioned above substrate 88 relative to a gravitational frame of reference when the printhead is mounted in the printing system. In the embodiment depicted by FIG. 7, two bubble accumulation chambers 168, 170 are formed on opposite sides of conduit 63. One chamber 168 is formed between wall 163 and an outer portion of the printhead housing 110. Another chamber 170 is formed between wall 162 and an outer portion of printhead housing 110.

A space between each slot 162, 163 and a distal end of conduit 63 defines a bubble escape opening. The bubble escape opening communicates between the ink flow path and the bubble accumulation chamber. In the embodiment depicted. Since the bottom surface 165 is substantially aligned in a direction parallel to the back surface of substrate 88 bubbles 112 are prevented from interfering with the flow of ink 92 through ink conduit 63 and around the edges of substrate 88 into the inlet channels 132 and then into ink ejection chambers 94.

For printers that have an intended high use rate, it would be preferable to have a larger volume between the filter and the printhead for the storage of air. For low use rate printers, this volume could be reduced. The filter carrier 200 height can be adjusted to readily provide varying volumes for bubble accumulation chambers 168, 170 depending on the anticipated out-gassing. In the preferred embodiment, these bubble accumulation chambers 168, 170 each have a capacity of 2 to 3 cubic centimeters; however, the capacity can be greater than or less than this preferred volume depending on the anticipated out-gassing. An acceptable range is approximately 1 to 5 cubic centimeters. Bubble accumulation chambers 168, 170 extend along the length of substrate 88 to be in fluid communication with all the ink channels 132 formed in barrier layer 104 on substrate 88.

The mesh size of filter 202 is sufficiently small that while ink may pass through the passages of the mesh, air bubbles under normal atmospheric pressure will not pass through the mesh passages that are wetted by the ink. As a result, the mesh also serves the function of an air check valve for the print cartridge.

Ink passes from reservoir 61 through conduit 63 and out of the distal opening in conduit 63. In a preferred embodiment, the ink flow 92 is in a first direction substantially perpendicular to substrate 88. The ink flow exits the distal end of conduit 63 in this first direction, and then is redirected in a second direction substantially parallel to substrate 88. In the embodiment depicted in FIG. 7, the ink forms a bifurcated flow pattern, wherein substantially half of the ink passes in the second direction, and the remaining ink passes in a third direction that is substantially opposite to the second direction. Laterally extending portions of the bottom surface 165 increase the heat transfer and direct the flow of ink in the second and third directions.

The laterally extending portions 167 work in cooperation with the ink slots 16, 163 to channel the ink flow path 92 around substrate 88 to maximize heat transfer to the ejected in droplets. In other words, this geometry minimizes the amount of heat transferred from substrate 88 to the ink contained in the bubble accumulation chambers. The laterally extending portions provide a converging geometry for the ink flow path to better direct ink in the flow path.

Bubble escape openings can be used to allow bubbles to escape from the ink flow path to the bubble accumulation chambers to prevent bubbles from occluding or substantially increasing flow resistance in the ink flow path.

FIG. 8 is perspective view of the print cartridge 18 with the tape 80 removed along with substrate 88 to ink slots 162 and 163, ink conduit 63, and chambers 168 and 170. In one embodiment, the preferred length of substrate 88 is approximately one-half inch. An adhesive/sealant is applied to headland areas 174 and 176, and the assembly of FIG. 7 is then secured to the print cartridge 18 as shown in FIG. 3. The adhesive/sealant at areas 174 and 176 squishes upward to secure the ends of the substrate 881 to the print cartridge body and insulate the conductive traces on the back of tape 80 so that they will not be shorted by any ink in the vicinity of the conductors. An adhesive/sealant along the top of headland walls 178 and 179 secures the tape 80 to the print cartridge body.

Figure 9:
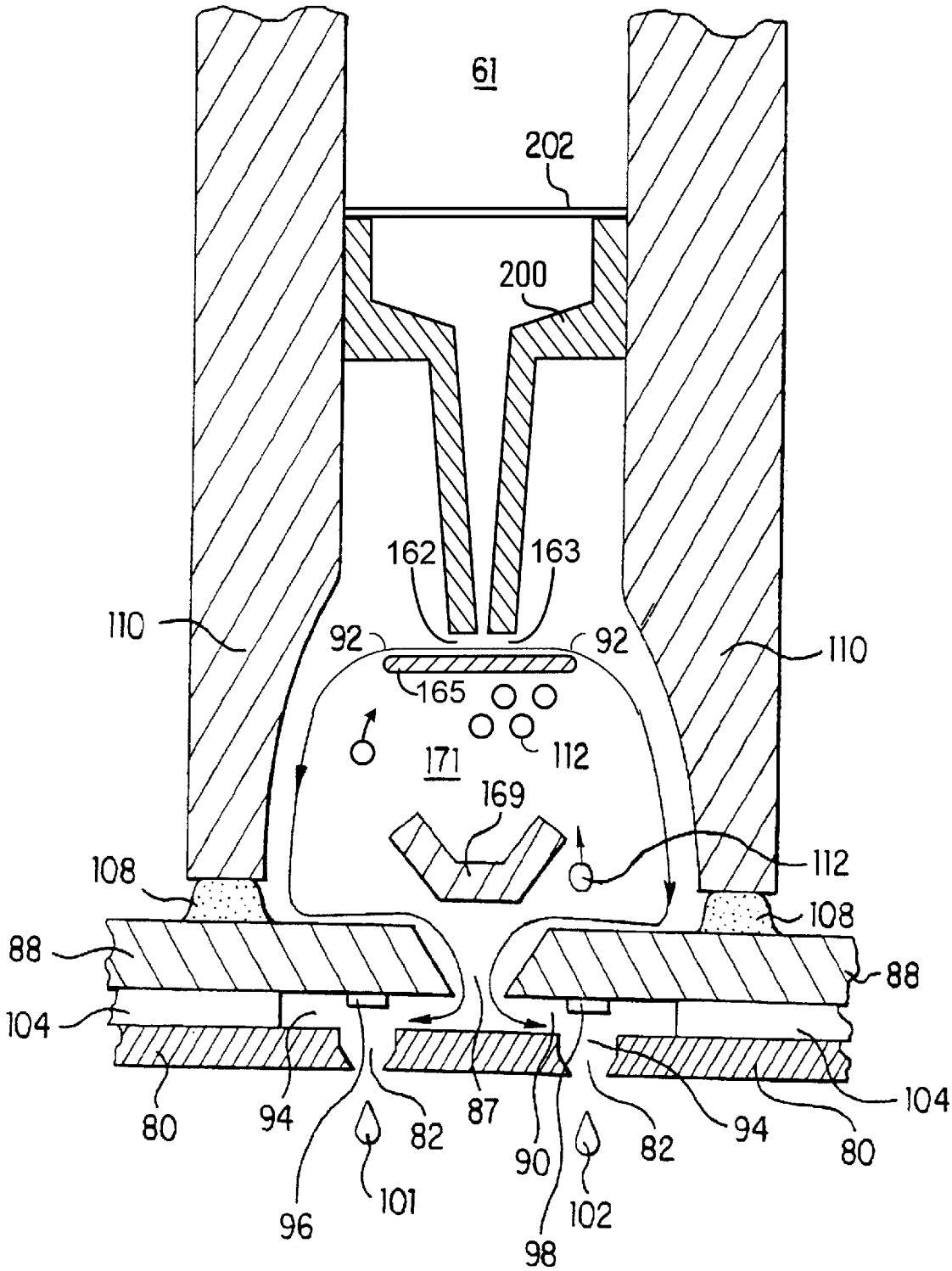
FIG. 9 is a cross-sectional view along line B—B of FIG. 2 showing the flow of ink to the ink ejection chambers in a center feed printhead using an embodiment of the present invention.

FIG. 9 is a cross-sectional view along line B—B of FIG. 2 showing a bifurcated flow of ink to the ink ejection chambers in a center feed printhead using another embodiment of the present invention. FIG. 9 shows a center feed printhead using impinging flow, wherein an ink flow path, shown by arrow 92, is formed by one end of filter carrier 200 and the inner wall of cartridge body 110. Flow director 169 then directs the ink flow 92 toward the central ink slot 87 in substrate 88. The flow director 169 helps the ink 92 to run along a larger surface area of substrate 88.

A central bubble accumulation chamber 171 is shown which accumulates bubbles 112 which have out-diffused from the ink as the ink is heated by substrate 88. Bubble accumulation chamber 171 is positioned substantially above substrate 88 relative to a gravitational frame of reference to collect bubbles generated proximate to a back surface of substrate 88. A laterally extending flow director 169 is positioned above ink feed slot. A bubble escape opening is defined between flow director 169 and the bottom surface 165 of the filter carrier 200. Bubbles that are generated in the ink flow path 92 escape through the bubble escape opening and to the bubble accumulation chamber. An opening is provided between the fluid director 169 and the bottom surface 165 to allow bubbles to escape into bubble accumulation chamber 169. Also, since the bottom surface 165 is substantially aligned in a direction parallel to the back surface of substrate 88, the ink flows horizontally out of the slots 162, 163, relative the substrate 88. This in turn helps trap more bubbles 112 in bubble accumulation chamber 169. Hence, bubbles 112 will not interfere with the flow of ink 92 through ink conduit 63' and into ink ejection chambers 94. The fluid director 169 also reduces the warming of the ink in the bubble accumulation chamber 171 and improves heat transfer between substrate 88 and the ink. The complete structure of the printhead illustrated in FIG. 9 would be readily understood by one skilled in the art.

The added heat withdrawn from the substrate due to the novel filter carrier 200 allows the printhead to operate at higher speeds without adversely affecting the print quality. The enhanced thermal performance does not rely on any attachments to the substrate, such as a heat exchanger. Such attachments would likely be much more complex and costly. The print cartridge may be a single-use disposable cartridge, a refillable cartridge, or a cartridge connected to an external ink supply.

Figure 10:
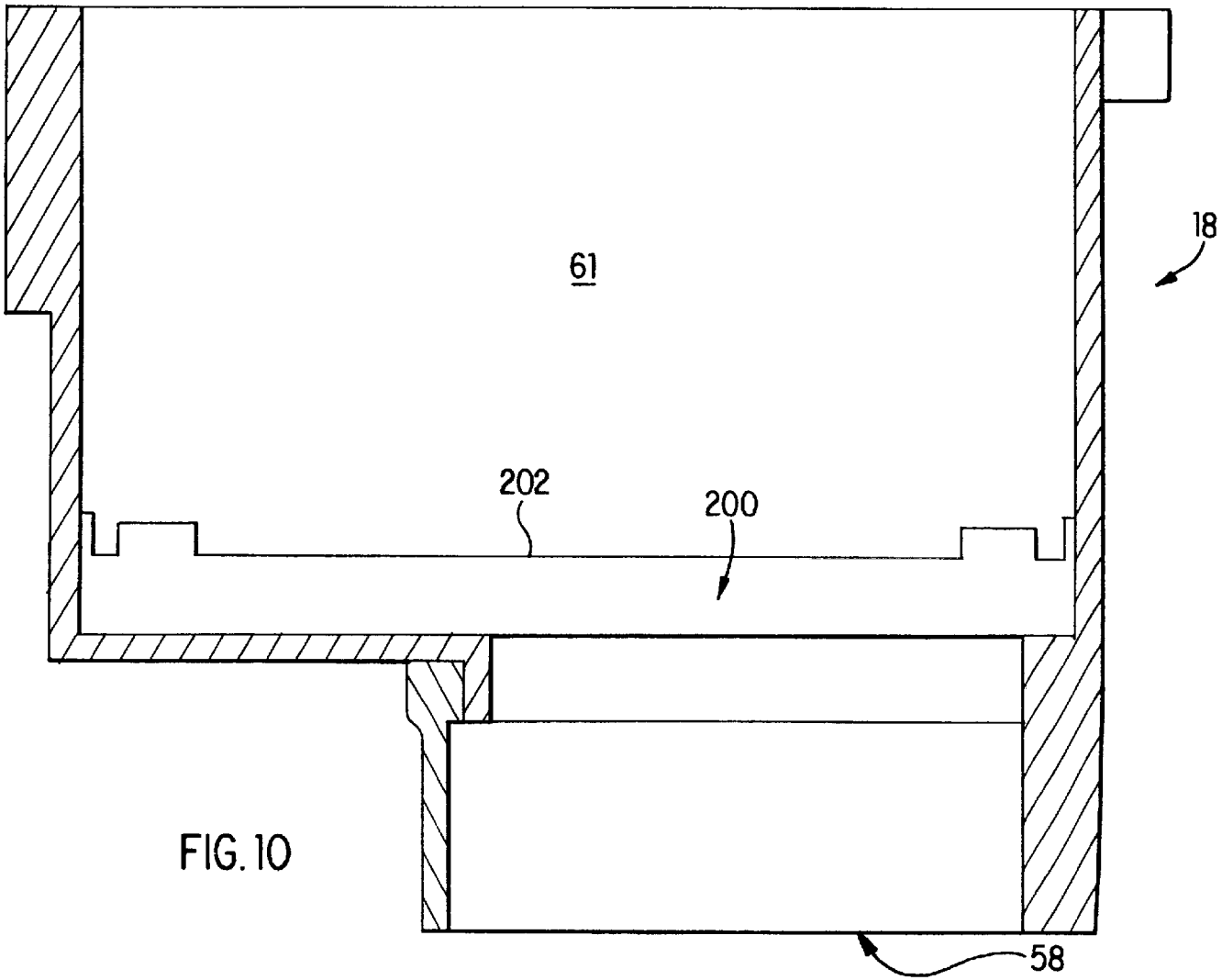
FIG. 10 is a cross-sectional view along line A—A of FIG. 5 illustrating the location of the filter carrier of the present invention in the print cartridge.

FIG. 10 is a cross-sectional view along line A—A of FIG. 5 illustrating the location of the filter carrier 200 of the present invention in the print cartridge 18. Filter carrier 200 is supported in cartridge 18 by support surfaces 190, 192. Filter carrier 200 is also supported walls 162, 163, which were described above. The position of the filter screen 202 is also shown.

Figure 11:
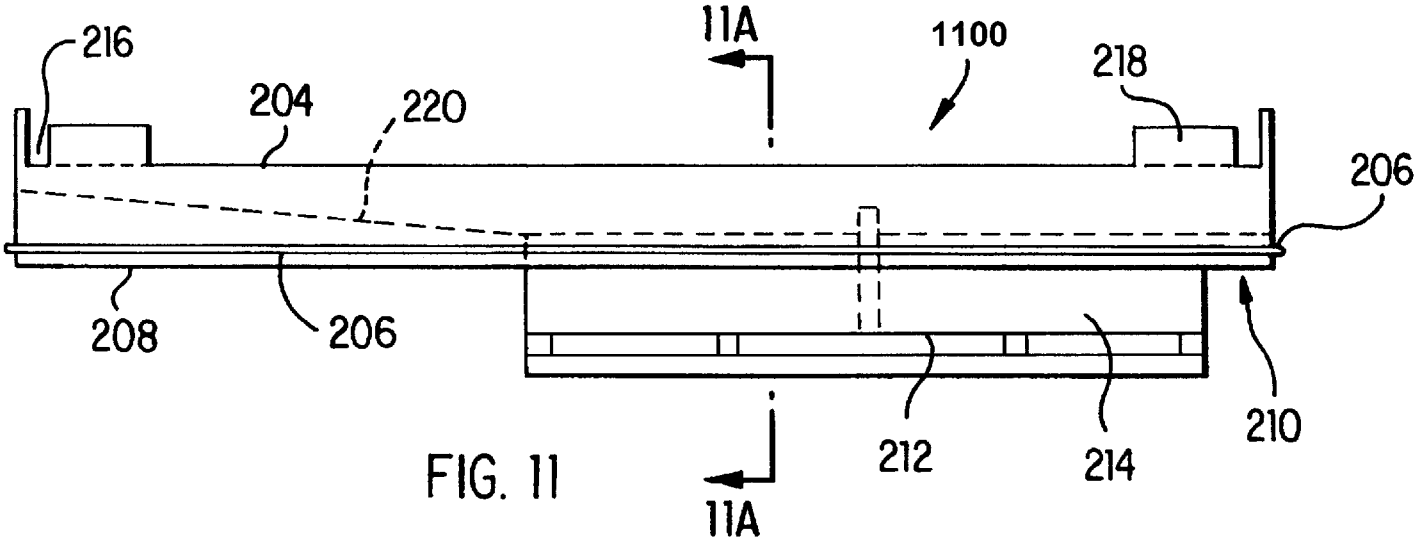
FIG. 11 is a side elevational view of the filter carrier of the present invention.
Figure 11A:
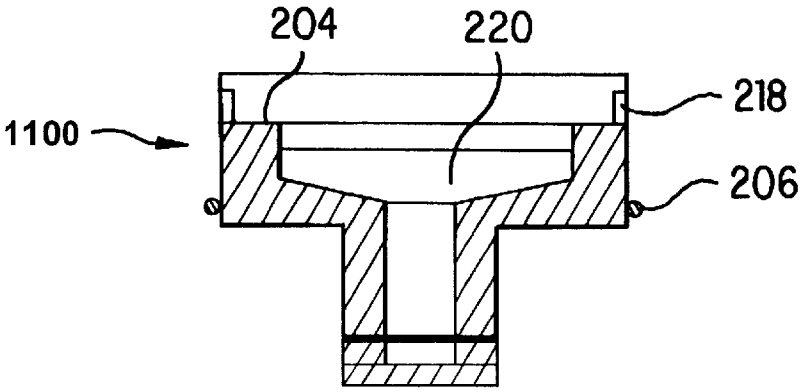
FIG. 11A is a cross-sectional view along line A—A of FIG. 11.

Referring to FIGS. 11 and 11A, filter screen 202 is attached to the top surface 204 of filter carrier 1100 through heat staking (heat and pressure welding), adhesives or other bonding processes, to form a leak-proof seal between the filter screen 202 and filter carrier 200. The filter carrier 1100 of FIGS. 11 and 11A has similar elements and is similar to filter carrier 200 of FIGS. 7–9, but alternatively has straight walls, as opposed to angled walls of filter carrier 200 of FIGS. 7–9. All filter carriers are preferably made of a plastic such as polypropylene or high density polyethylene, or other suitable material. Filter screen 202 is attached to the top surface 204 of filter carrier 200 through preferably heat staking (heat and pressure welding), or alternatively, adhesives or other bonding processes, to form a leak-proof seal between the filter screen 202 and filter carrier 200. The filter screen 202 is formed of a material, which is permeable to the ink to be stored within the ink reservoir, and compatible with the plastic of material from which the filter carrier 200 is fabricated. A preferred material for the filter screen 202 is a section of finely woven stainless steel mesh, the periphery edges of which are attached to the top surface 204 of filter carrier 200 by heat staking. The mesh has a nominal passage dimension of 15 microns between adjacent mesh strands, and has a typical thickness of less than 0.005 inches.

The filter carrier 200 is inserted into the cartridge body 110 such that the bottom surfaces 208, 210 of filter carrier 200 rest on cartridge body surfaces 190, 192, respectively, and lower surface 212 of the snout portion 214 of filter carrier 200 is connected to the bottom surface 165, which has ink slots 162, 163 formed therethrough. The inside of the filter carrier 200 has square corners for ink to wick up in the event that air fills the filter standpipe. The manufacture of the square corners is facilitated by slits 216. Tabs 218 hold filter screen 202 in place during the heat staking process to filter carrier 200. The sloping surface 220 of filter carrier 200 helps prevent trapping of air during the cartridge filling process. Grooves 222 are provided to prevent distortion during the molding process for filter carrier 200.

The filter carrier 200 has a carrier seal 206 on all sides to engage a housing seal surface disposed on the inside walls of the housing 18 to define a seal zone that separates chamber 61 from the region in fluid communication with printhead and make a leak proof seal around the filter carrier 200 and the cartridge body 110. The carrier seal 206 is adapted to deform upon installation of the filter carrier 200 in the housing 110 and provide a reliable seal.

Another problem that occurs during the life of the print element is air out gassing. Air builds up between the filter and the printhead during operation of the printhead. For printers that have a high use model, it would be preferable to have a larger volume between the filter and the printhead for the storage of air. For low use rate printers, this volume would be reduced. The present invention also addresses this problem. The filter carrier 200 height can be adjusted to readily provide varying volumes for chambers 168, 170 depending on the anticipated out-gassing.

The mesh passage size is sufficiently small that while ink may pass through the passages of the mesh, air bubbles under normal atmospheric pressure will not pass through the mesh passages, which are wetted by the ink. The required air bubble pressure necessary to permit bubbles to pass through the mesh, in this embodiment, about 30 inches of water, is well above that experienced by the pen under any typical storage, handling or operational conditions. As a result, the mesh also serves the function of an air check valve for the print cartridge.

The present invention allows a wide range of product implementations other than that illustrated in FIG. 2. For example, such ink delivery systems may be incorporated into an inkjet printer used in a facsimile machine. While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. An inkjet printhead, comprising:

a housing defined by inner walls and being coupled to an ink reservoir at an upper portion and nozzles at a lower portion;

a substrate located near the lower portion of the housing and having a front surface facing the nozzles and a back surface facing the ink reservoir, wherein the front surface has ink ejection chamber formed thereon; and a filter carrier extending from the ink reservoir and coupled to the inner walls of the housing of the printhead and having at least one ink slot with an opening facing at least one side of the inner walls and located in close proximity to the back surface of the substrate.

2. The inkjet printhead of claim 1, wherein each side of the filter carrier has plural ink slots with openings that face each side of the respective inner walls.

3. The inkjet printhead of claim 2, wherein an ink flow path is defined by the ink slots, the inner walls and the substrate through which substantially all the ink flows to the ink ejection chambers.

4. The inkjet printhead of claim 3, further comprising a bubble accumulation chamber in communication with the ink flow path such that buoyancy of bubbles that accumulate in the ink flow path moves the bubbles into the bubble accumulation chamber.

5. The inkjet printhead of claim 1, wherein the filter carrier includes a substantially planar surface having a substantially planar filter affixed to the planar surface.

6. The inkjet printhead of claim 5, wherein air bubble blockage of the filter is avoided by trapping bubbles in a designated area.

7. The inkjet printhead of claim 5, wherein the filter carrier is fabricated from a plastic material onto which the filter is attached prior to coupling the filter carrier to the inner walls.

8. The inkjet printhead of claim 5, wherein the filter is located between the filter carrier and an ink reservoir.

9. The inkjet printhead of claim 8, wherein the filter is attached to filter carrier with a heat staking process.

10. The inkjet printhead of claim 1, wherein the ink reservoir is coupled to an external ink supply in fluid communication with the ink reservoir.

11. The inkjet printhead of claim 10, wherein the inkjet printhead is coupled to a scanning carriage that scans the printhead across a media as the printhead ejects droplets of ink.

12. The inkjet printhead of claim 11, wherein the external ink supply is located on the scanning carriage.

13. The inkjet printhead of claim 11, wherein the external ink supply is located off the scanning carriage.

14. The inkjet printhead of claim 1, wherein the filter carrier is fabricated from a different material than the housing to optimize the attachment of the filter to the filter carrier.

15. A method of delivering ink to an printhead, the method comprising the steps:

forming ink ejection chambers on a front surface of a substrate located within a housing of the printhead and forming ink ejection elements within the ink ejection chambers;

mounting a filter carrier to inner walls of the housing and between an ink reservoir facing a back surface of the substrate and the ink ejection chambers, wherein the filter carrier has ink slots with openings facing each side of the inner walls and located in close proximity to the back surface of the substrate;

connecting a filter to the filter carrier in an ink flow path between the ink reservoir and the ink ejection chambers; and transporting ink from the ink reservoir through the further to the ink ejection chambers.

16. The method of claim 15, further comprising trapping bubbles in a designated area to prevent air bubble blockage of the filter.

17. The method of 15, further comprising connecting a scanning carriage to the printhead, wherein the scanning carriage scans the printhead across a media as the printhead ejects droplets of ink.

18. The method of claim 15, wherein inserting the filter carrier into the housing comprises press fitting the filter carrier into the housing.

19. A printing system, comprising:

an ink reservoir;

ink ejection nozzles;

a housing defined by inner walls and coupled to the ink reservoir at an upper portion and the ink ejection nozzles at a lower portion;

a substrate located near the lower portion of the housing and having a back surface facing the ink reservoir and a front surface facing the ink ejection nozzles, wherein the front surface has ink ejection chambers formed thereon;

a filter carrier extending from the ink reservoir and coupled to the inner walls of the housing of the printhead and having at least one ink slot with an opening facing at least one side of the inner walls and located in close proximity to the back surface of the substrate; and a bubble accumulation chamber in communication with an ink flow path defined by the ink slots, the inner walls and the substrate through which ink flows to the ink ejection chambers, wherein the buoyancy of bubbles that accumulate in the ink flow path moves the bubbles into the bubble accumulation chamber.

20. The printing system of claim 19, wherein the filter carrier includes a substantially planar surface having a substantially planar filter affixed to the planar surface and wherein air bubble blockage of the filter is avoided by trapping bubbles in a designated area.

* * * * *

UNITED STATES PATENT AND TRADEMARK OFFICE

CERTIFICATE OF CORRECTION

PATENT NO. : 6,457,821 B1
DATED : October 1, 2002
INVENTOR(S) : Liu et al.

It is certified that error appears in the above-identified patent and that said Letters Patent is hereby corrected as shown below:

Column 12,
Line 25, delete “further” and insert therefor -- filter --.

Signed and Sealed this

Twenty-seventh Day of January, 2004

JON W. DUDAS
*Acting Director of the United States Patent and Trademark Office*